US005383486A

United States Patent [19]

Warner et al.

[11] Patent Number: 5,383,486

[45] Date of Patent: Jan. 24, 1995

[54] METHOD OF OPERATING A WAREWASHER DRAIN VALVE

[75] Inventors: Charles E. Warner, Troy; Richard W. Cartwright, Piqua; James M. Straughn, Troy, all of Ohio

[73] Assignee: Premark FEG Corporation, Wilmington, Del.

[21] Appl. No.: 233,380

[22] Filed: Apr. 26, 1994

[51] Int. Cl.[6] ..... F16K 51/00

[52] U.S. Cl. ..... 137/15; 134/25.2; 134/104.1

[58] Field of Search ..... 137/15, 242; 134/25.2, 134/104.1

[56] References Cited

U.S. PATENT DOCUMENTS 5,178,684 1/1993 Hutchins, Sr. ..... 137/15 X

*Primary Examiner*—John C. Fox

*Attorney, Agent, or Firm*—Thompson, Hine & Flory

[57] ABSTRACT

The invention relates to a method for operating a warewasher drain valve having a valve cover and a drain. The method comprises the step of rapidly reciprocating the valve cover from a first position closing the drain to a second position in which the drain is opened.

9 Claims, 1 Drawing Sheet

METHOD OF OPERATING A WAREWASHER DRAIN VALVE

BACKGROUND OF THE INVENTION

This invention relates to a method in which obstructions to the drain valve of a warewasher can be removed.

A drain valve commonly used in a warewasher typically includes a valve cover and a seal. The valve cover acts to direct the flow of wash water through the piping of a warewasher. In one position, the valve cover allows the water to flow from a sump, through the pipe and into the wash portion of the warewasher. In a second position, it moves to obstruct the pipe and causes the water to flow from the sump, partially through the pipe and out the drain. As water is pumped through the warewasher in the course of a day's operation, debris can become lodged around the valve thereby clogging or otherwise disabling it. For example, items such as toothpicks, pieces of aluminum foil and straws may become lodged in the drain valve of the warewasher interfering with the proper operation of the machine. In one instance, the drain valve may be obstructed so that it remains in an open position which allows a portion of the water being circulated through the machine to be pumped out of the machine through the drain. In another instance, the obstructions may cause the drain valve to become lodged in a closed position so that the machine will not drain properly and may possibly overflow.

In order to prevent debris from entering into the working portions of the machine and causing obstructions, a warewasher typically includes a coarse screen which acts to screen out debris larger than the mesh size of the screen. The debris is then removed from the screen manually. However, some debris can and does pass through the screen. To further aid in preventing unwanted debris from entering the working portions of the machine, the machine typically includes a second, fine screen which acts to exclude debris which has passed through the coarse screen. However, debris, smaller than the mesh size of the fine screen, can pass through the fine screen and collect around the drain valve and drain. The debris can eventually cause an obstruction of the drain valve and drain.

A need has developed in the industry for a method which removes obstructions from the drain valve and drain area of a warewasher.

SUMMARY OF THE INVENTION

The present invention relates to a method for operating a warewasher drain valve including a valve cover and a drain. The method comprises the step of rapidly reciprocating the valve cover from a first position closing the drain to a second position in which the drain is opened.

DETAILED DESCRIPTION

Figure 1:
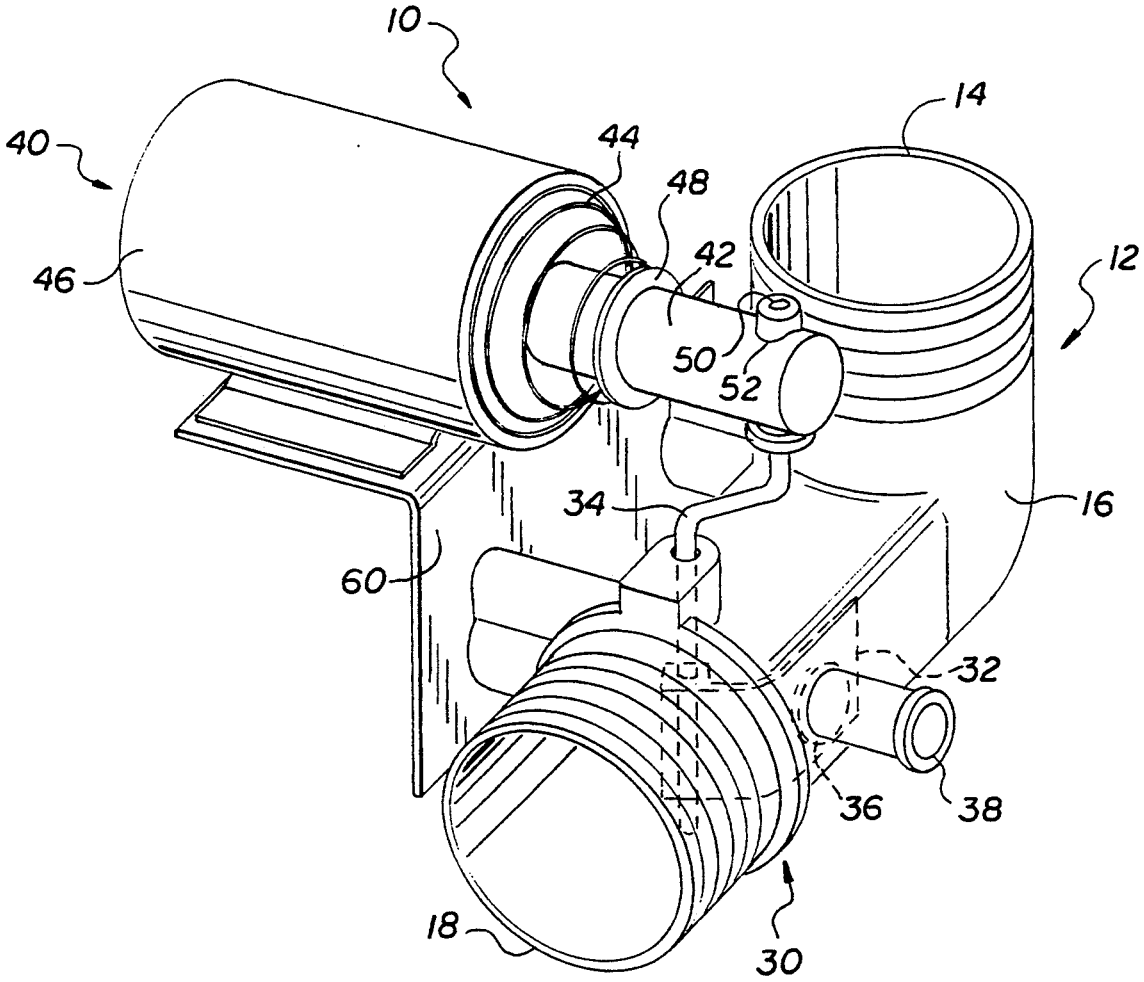
FIG. 1 presents a perspective view of one valve apparatus with which the process of this invention is useful.

The method of the present invention is useful with a fresh water rinse warewasher or "tank" warewasher. This warewasher has a relatively large sump located beneath the ware rack which holds approximately 3–16 gallons of water. In a typical cycle, the sump is filled with water and a proportionate amount of detergent is added for washing. The water in the sump is used and reused by pumped recirculation of the wash water for washing successive racks of ware. Fresh water is added after each wash cycle by means of a fresh water spray system which rinses the rack of ware after it has been washed. Fresh water rinsing is performed while the recirculation pump is deactivated. Approximately 1.2 gallons of fresh water is added to the wash water in each cycle to rinse the current rack of ware. Because fresh water is added to the tank during the rinse, the system does a partial pumped drain between the wash and rinse cycles. The warewasher will drain an amount of water approximately equal to that which was added. One advantage of this fresh water rinse system is that a large volume of wash water is re-used in subsequent cycles. The sump can be completely drained periodically after several wash cycles, at which time the water in the sump is fairly soiled, and after operation has ceased for the day.

The method of this invention is also useful with a fill and dump warewasher. In this type of warewasher, the water is drained from the warewasher after each step of the wash cycle. With a fill and dump warewasher, the sump fills before the wash cycle, drains after the wash cycle is completed, and then fills again before the rinse cycle. After the rinse cycle, the wash water again drains and the machine refills to begin another wash cycle. For most cases, when the water usage rate is high, the wash water may be retained between cycles.

FIG. 1 presents a perspective view of a drain valve system 10 with which the method of this invention is useful. Drain valve system 10 includes pipe 12, valve 30, solenoid 40 and bracket 60. Pipe 12 includes first end 14 into which water is pumped from the wash water sump; elbow 16; and second end 18 through which the water is pumped into the wash chamber to wash the ware.

Wash water flow through pipe 12 is controlled by valve 30. Valve 30 includes valve cover 32 and valve arm 34. Cap 50 is rotatably mounted on valve arm 34. Valve 30 further includes conical seal 36, typically made of rubber, mounted on valve cover 32. Drain pipe 38 opens off of pipe 12. Conical seal 36 acts to block drain pipe 38 so that water flow from the sump into the wash chamber will not be siphoned off into drainspipe 38. In a first position, valve cover 32 is moved to close pipe drain 38 to allow the water to flow through pipe 12 into the wash apparatus. In a second position, valve cover 32 is moved to redirect the flow of wash water from the sump and out through drain pipe 38.

Solenoid 40 is mounted on bracket 60 which is journalled to pipe 12. Solenoid 40 includes solenoid arm 42 and spring 44. Spring 44 rests, at one end, on solenoid body 46 and is retained, at its other end, by washer 48. Washer 48 is attached to solenoid arm 42. Solenoid arm 42 further includes notch 52 which engages cap 50. Arm 42 is biased away from solenoid 40 by means of spring 44. When valve cover 32 is in the first position, solenoid arm 42 is extended away from solenoid body 46. To place valve cover 32 in the second position, solenoid 40 draws solenoid arm 42 into solenoid body 46. This causes drain pipe 38 to be opened.

Because the wash water in a fresh water rinse warewasher is recirculated, debris tends to pass through the strainer screens and build up around valve cover 32. Debris will also pass through the strainer screens of a fill and dump machine and build up around valve cover 32. In either type of machine, this buildup causes valve cover 32 to become offset from drain pipe 38 which allows water to flow out drain pipe 38. This enables water, which is flowing in from the pump and out to the washer, to be partially drained as it is being circulated. This partial drain results in increased water usage by both types of warewashers and also in ineffective wash cycles for the ware. The debris buildup also prevents a complete draining of the warewasher by preventing valve 30 from moving to a fully opened position to allow for proper drainage.

In order to prevent debris from becoming built up around valve 30 and drain pipe 38 after the wash water has been drained from the warewasher, valve cover 32 is rapidly reciprocated to remove any debris from valve 30, conical seal 36 and drain pipe 38. The movement of valve cover 32 occurs after the warewasher's shut down cycle has been activated. This is because, once the machine is shut off, the warewasher automatically will dump all used wash water which is contained in the warewasher's sump. Thus, when the machine is activated to begin wash operations, the sump will first be filled with clean wash water.

The method of moving valve cover 32 occurs in accordance with the following steps. First, the warewasher is switched to its shut down cycle. To provide for a continuous cycle of operation and to prevent the warewasher from operating when it contains no water, the method of this invention will only activate when the warewasher has ceased washing operations. Next, valve cover 32 is moved to the second position and the used wash water is pumped from the sump, into the first end 14 and out through drain pipe 38 to be drained from the warewasher. This draining continues, in typical machines, until the sump is drained or, in other typical machines, until the water level in the warewasher sump reaches an indicating probe. Once the water level reaches the indicating probe, the water will continue to be drained from the apparatus for approximately 20 seconds. After the draining is completed, valve cover 32 is rapidly reciprocated from the first position to the second position by the action of solenoid 40. Typically, the valve cover 32 will be reciprocated at least twice, and preferably, three to five times over a short period of time. In a particular embodiment, valve cover 32 is reciprocated over a six second period of time. Upon completion of the reciprocation of valve cover 32, the warewasher then deactivates.

Valve cover 32 is reciprocated from the first position to the second position when solenoid 40 contracts solenoid arm 42 into the solenoid body 46. This action causes notch 52 to draw valve arm 34 toward solenoid body 46 by means of cap 50. As cap 50 rotates, valve arm 34 moves toward solenoid body 46 until washer 48 stops its motion. At that point, valve 30 is in the second position. Valve cover 32 is closed when the electric supply to solenoid 40 is interrupted and spring 44 pushes solenoid arm 42 toward first position by means of washer 48. Notch 52 forces valve arm 34 away from solenoid body 46 as cap 50 rotates on arm 34. When this action is completed, valve cover 32 is in the first position covering drain pipe 38.

Once the debris has been dislodged from around the drain valve 30, the debris will eventually be carried into the wash arms of the warewasher by the water flow through pipe 12 and the remainder of the warewasher. The debris can then be easily removed from the machine by removing and cleaning the wash arms of the warewasher.

Having described the invention in detail and by reference to preferred embodiments thereof, it will be apparent that modifications and variations are possible without departing from the scope of the invention defined in the appended claims.

What is claimed is:

1. A method for operating a warewasher drain valve, the valve being situated in a first pipe having a first end into which fluid flows from a sump and a second end from which fluid flows to a wash apparatus, a drain pipe opening on the first pipe through which fluid is pumped from the warewasher, the valve including a valve cover, operating from a first position closing the drain pipe which permits fluid to flow from the first end of the pipe to the second end of the pipe to a second position in which the drain pipe is open and fluid is pumped from the first pipe through the drain, the method comprising the step of rapidly reciprocating the valve cover between the first position and the second position to dislodge debris which may become trapped by the valve cover.

2. The method of claim 1 wherein the valve cover is reciprocated at least two times.

3. The method of claim 2 wherein the valve cover is reciprocated at least three times.

4. The method of claim 3 wherein the valve cover is reciprocated three times within a period of less than six seconds.

5. The method of claim 4 wherein the warewasher is a fresh water rinse warewasher.

6. The method of claim 4 wherein the warewasher is a fill and dump warewasher.

7. The method of claim 1 wherein prior to rapidly reciprocating the valve cover, the method includes the step of draining the fluid from the sump.

8. The method of claim 7 wherein, prior to draining the fluid from the warewasher sump, the method includes the step of initiating the warewasher's shut down cycle.

9. The method of claim 1 wherein the valve is reciprocated by means of a solenoid.

* * * * *